US012668953B2

(12) United States Patent
Kenkel et al.

(10) Patent No.: US 12,668,953 B2
(45) Date of Patent: Jun. 30, 2026

(54) WORK MACHINE IMPLEMENT CONTROL FOR AUTONOMOUS SUBTERRANEAN SURVEYING AND MARKING APPLICATIONS

(71) Applicant: Deere & Company, Moline, IL (US)

(72) Inventors: Aaron R. Kenkel, Hazel Green, WI (US); Thomas L. Kennedy, Bettendorf, IA (US); Stephen R. Corban, Geneseo, IL (US); Jeffery W. Dobchuk, Saskatoon (CA); Brett S. Graham, Dubuque, IA (US)

(73) Assignee: Deere & Company, Moline, IL (US)

( * ) Notice: Subject to any disclaimer, the term of this patent is extended or adjusted under 35 U.S.C. 154(b) by 225 days.

(21) Appl. No.: 18/630,332

(22) Filed: Apr. 9, 2024

(65) Prior Publication Data

US 2025/0314047 A1 Oct. 9, 2025

(51) Int. Cl.
*E02F 9/26* (2006.01)
*E02F 3/43* (2006.01)

(52) U.S. Cl.
CPC ..... *E02F 9/262* (2013.01); *E02F 3/437* (2013.01)

(58) Field of Classification Search
CPC . E02F 9/262; E02F 9/245; E02F 9/261; E02F 3/437
See application file for complete search history.

(56) References Cited

U.S. PATENT DOCUMENTS 4,600,356 A * 7/1986 Bridges ..... E02F 9/245 172/6
4,945,221 A 7/1990 Nielsen et al.
(Continued)

FOREIGN PATENT DOCUMENTS

DE 10160084 A1 7/2002
DE 102016207973 A1 11/2017
(Continued)

OTHER PUBLICATIONS

German Search Report issued in application No. 102025102036.1 dated Oct. 7, 2025, 14 pages.

*Primary Examiner* — Russell Frejd
(74) *Attorney, Agent, or Firm* — Gary L. Montle; Lucian Wayne Beavers; Patterson Intellectual Property Law, PC

(57) ABSTRACT

A work machine comprises or otherwise has associated therewith a subterranean monitoring sensor, such as a ground penetrating radar, electromagnetic locator, etc. During a subterranean monitoring operation, movements of the work machine may be controlled according to a defined traverse plan, e.g., associated with electronic worksite maps. A controller for the work machine, a remote server, or the like may detect subterranean objects via output signals from the subterranean monitoring sensor, and automatically map parameters associated with detected objects to respective locations in the electronic worksite map. In addition, or alternatively, the controller may automatically generate visual marks on the surface of the terrain corresponding to identified locations of the subterranean objects, based on currently and/or previously identified locations. In some embodiments, data from multiple monitoring operations may be aggregated in data storage and utilized for subsequent earth working operations by generating worksite maps having the object data mapped thereto.

19 Claims, 8 Drawing Sheets

(56) References Cited

U.S. PATENT DOCUMENTS

| | | | | |
|---|---|---|---|---|
| 5,493,798 | A | 2/1996 | Rocke et al. | |
| 5,592,092 | A * | 1/1997 | Mechler | E02F 9/245 324/67 |
| 6,236,924 | B1 | 5/2001 | Motz et al. | |
| 6,247,538 | B1 | 6/2001 | Takeda et al. | |
| 6,477,914 | B1 | 11/2002 | Krieger | |
| 6,736,216 | B2 | 5/2004 | Savard et al. | |
| 7,477,973 | B2 | 1/2009 | Brewer et al. | |
| 7,934,329 | B2 | 5/2011 | Mintah et al. | |
| 8,141,650 | B2 | 3/2012 | Breiner et al. | |
| 8,180,532 | B2 | 5/2012 | O'Halloran et al. | |
| 8,634,991 | B2 | 1/2014 | Douglas | |
| 8,689,471 | B2 | 4/2014 | Carpenter et al. | |
| 8,817,238 | B2 | 8/2014 | Montgomery | |
| 8,919,455 | B2 | 12/2014 | Hendron et al. | |
| 9,074,546 | B2 | 7/2015 | Asami et al. | |
| 9,187,879 | B2 | 11/2015 | Suk | |
| 9,234,329 | B2 | 1/2016 | Jaliwala et al. | |
| 9,328,479 | B1 | 5/2016 | Rausch et al. | |
| 9,428,885 | B2 | 8/2016 | Nau | |
| 9,551,115 | B2 | 1/2017 | Engels et al. | |
| 9,551,130 | B2 | 1/2017 | Hendron et al. | |
| 9,581,691 | B2 | 2/2017 | Simicevic et al. | |
| 9,624,643 | B2 | 4/2017 | Hendron et al. | |
| 9,638,525 | B1 | 5/2017 | Willis | |
| 9,976,285 | B2 | 5/2018 | Padilla | |
| 9,995,016 | B1 | 6/2018 | Howell et al. | |
| 10,094,654 | B2 | 10/2018 | Crozier et al. | |
| 10,401,176 | B2 | 9/2019 | Nackers et al. | |
| 10,532,741 | B2 | 1/2020 | Kean et al. | |
| 10,704,233 | B2 | 7/2020 | Dusha | |
| 10,883,248 | B2 | 1/2021 | Stotlar | |
| 11,085,170 | B2 | 8/2021 | Roulston et al. | |
| 11,414,839 | B2 | 8/2022 | Shintani et al. | |
| 2002/0063652 | A1* | 5/2002 | Price | E02F 9/245 342/22 |
| 2008/0047170 | A1 | 2/2008 | Nichols | |
| 2010/0052684 | A1* | 3/2010 | Fling | G01V 3/15 324/326 |
| 2010/0207633 | A1* | 8/2010 | Fling | E02F 9/245 324/326 |
| 2011/0311342 | A1 | 12/2011 | Montgomery | |
| 2013/0002256 | A1* | 1/2013 | Branson | G01V 3/15 324/326 |
| 2013/0080112 | A1 | 3/2013 | Friend | |
| 2013/0103247 | A1 | 4/2013 | Ogawa et al. | |
| 2014/0168009 | A1 | 6/2014 | Peake | |
| 2014/0343800 | A1 | 11/2014 | Nelson et al. | |
| 2016/0003171 | A1 | 1/2016 | Ge | |
| 2016/0225107 | A1* | 8/2016 | Nielsen | G06Q 10/06398 |
| 2016/0258128 | A1 | 9/2016 | Nakamura et al. | |
| 2019/0100205 | A1 | 4/2019 | Kean et al. | |
| 2019/0234045 | A1 | 8/2019 | Wiewel et al. | |
| 2020/0042023 | A1 | 2/2020 | Garvin et al. | |
| 2020/0349760 | A1 | 11/2020 | Hendron | |
| 2021/0189667 | A1 | 6/2021 | Fritz | |
| 2023/0389458 | A1* | 12/2023 | Ekhe | G05D 1/0274 |

FOREIGN PATENT DOCUMENTS

| | | | |
|---|---|---|---|
| DE | 102019125045 | A1 | 3/2020 |
| DE | 102019125702 | A1 | 4/2020 |
| DE | 102020110123 | A1 | 10/2020 |
| DE | 102021205025 | A1 | 12/2021 |
| WO | 2008129345 | A1 | 10/2008 |
| WO | 2021157381 | A1 | 8/2021 |

* cited by examiner

WORK MACHINE IMPLEMENT CONTROL FOR AUTONOMOUS SUBTERRANEAN SURVEYING AND MARKING APPLICATIONS

FIELD OF THE DISCLOSURE

The present disclosure relates generally to the surveying and marking of subterranean elements such as utility locations, and more particularly to systems and methods for facilitating subterranean mapping and/or physical marking of locations in a worksite using for example work machines such as excavators having subterranean monitoring capabilities.

BACKGROUND

Work operations in worksites may frequently involve ground disturbing operations in which the ground adjacent or under the machines is excavated, scraped, or otherwise disturbed. A number of different problems can arise in performing these types of operations. For instance, there may be items underground which will be destroyed by the ground disturbing operation. By way of example, there may be underground utilities (such as electrical wires, fiber optic cables, gas lines, water/sewer lines, etc.) buried under the ground to be disturbed. When the ground disturbing operation is performed (such as an excavation) the excavation may damage or destroy these items. Repairs can be time consuming and expensive. Similarly, where the item that is damaged is hazardous (such as a gas line), damaging the item may be dangerous for operators and equipment in the vicinity of the operation.

Various examples of systems and methods for worksite analysis using subterranean monitoring technology, including but not limited to ground penetrating radar (GPR), electromagnetic location (EML), and equivalent systems and techniques thereto, are conventionally known. In one example, a worker pushes and/or pulls a GPR-equipped cart across a workspace, wherein inconsistencies in the ground beneath the cart can be identified and visualized from the output data. The detection locations may be marked with paint on the ground, but the depth in such cases is usually not indicated to the machine operators.

Some work machines such as excavators and backhoes are also known to have GPR-equipped work implements such as buckets which can perform substantially the same task described above for manually driven carts, but with the implement movement for example being hydraulically actuated via user interface tools from a cab.

In one conventional example, the bucket is set flat on the ground and the bucket start position is manually marked using paint or an equivalent. Upon initiation of the scans by an operator, for example using a display unit as a user interface tool, the operator further drags the bucket (e.g., in a linear and/or radial fashion) across the ground surface, preferably maintaining constant contact and speed, while keeping the bucket as level as possible. When the process is completed, for example as indicated by the machine operator via the display unit, the bucket end position may be marked, again manually using paint or an equivalent. Detection positions may be indicated on the display unit, for example using coordinates and/or with GPR results. The excavator operator typically shouts the detected positions out to other workers external to the work machine, who mark them on the ground surface, again with paint or an equivalent.

One problem with such a technique is that the operator conventionally maintains the bucket (or other relevant implement including the GPR sensors) in constant contact with the ground surface during the dragging/scanning process by visual and feel. When constant contact is not maintained, the scan provides bad data and must be repeated. To compensate, the operator tends to over-apply pressure to the point that the front of the machine begins lifting off the ground. Over time, this can understandably be stressful on machine components.

Another problem is that during the scanning process, the operator is trying to maintain constant contact while scanning a useful amount of workspace. There are no indicators provided when constant contact is not maintained, and taking longer passes allows for more opportunities for the operator to make a mistake and ruin the entire data set.

BRIEF SUMMARY

The current disclosure provides enhancements to conventional systems for subterranean worksite mapping, at least in part by utilizing work machines such as excavation equipment (like an excavator or backhoe loader) on site, and potentially capable of autonomous operation.

An autonomous work machine equipped with a ground marking system on a work implement may be capable of marking out a job site with utility locations built into a design file. In this scenario, the work machine may utilize existing machine automation systems (kinematic sensing, geospatial locating, etc.) to automate motion of the ground marking system.

Additionally, or in the alternative, the autonomous work machine may be capable of identifying utility locations if equipped with surveying equipment (radar, electromagnetic devices, etc.). In this scenario, the work machine may utilize the existing machine automation system in conjunction with the surveying equipment to sweep the worksite and identify utilities. The machine could then build a design file (similar to an "as built" surface from a grade management system) to digitally represent survey locations, or could utilize the ground marking system to mark them in real time.

In one particular and exemplary embodiment, a method is disclosed herein for operating a work machine comprising a machine frame, and one or more ground engaging units supporting the machine frame and configured to traverse a terrain. The method comprises detecting at least a first type of subterranean object via output signals from a subterranean monitoring sensor associated with the work machine, and one or more parameters associated with the at least first type of detected object are automatically mapped to respective locations in an electronic worksite map.

In one exemplary aspect according to the above-referenced method embodiment, and optionally supplemented by other exemplary aspects referenced herein, the method comprises accessing the electronic worksite map residing in data storage, and generating a traverse plan according to the worksite map and associated with a subterranean monitoring operation. During the subterranean monitoring operation, at least a trajectory at which the work machine traverses the terrain is controlled according to the generated traverse plan.

In another exemplary aspect according to the above-referenced method embodiment, and optionally supplemented by other exemplary aspects referenced herein, the method comprises, via a ground marking unit associated with the work machine, automatically generating a visual mark on the surface of the terrain corresponding to identified locations of the at least first type of subterranean object, wherein the identified locations are previously stored and retrieved from the electronic worksite map and/or correspondingly detected via the subterranean monitoring sensor.

In another exemplary aspect according to the above-referenced method embodiment, and optionally supplemented by other exemplary aspects referenced herein, the subterranean monitoring sensor may be associated with an attachment towed or driven by the work machine and external to the machine frame. Alternatively, the work machine may comprise a work implement moveable relative to the machine frame and having a ground engaging portion for working the terrain, wherein the traverse plan associated with the subterranean monitoring operation is independent of an earth working operation of the work implement, and the subterranean monitoring sensor is positioned in association with the ground engaging portion of the implement.

In another exemplary aspect according to the above-referenced method embodiment, and optionally supplemented by other exemplary aspects referenced herein, the method further comprises determining one or more position characteristics of the subterranean monitoring sensor by fusing input signals from at least a first position sensor associated with the attachment or work implement with position signals from a second position sensor associated with the main frame in a coordinate system independent of a global navigation frame for the electronic worksite map, and determining a location of the subterranean monitoring sensor at least in part by converting the determined one or more position characteristics of the subterranean monitoring sensor into coordinates associated with the global navigation frame.

In another exemplary aspect according to the above-referenced method embodiment, and optionally supplemented by other exemplary aspects referenced herein, the traverse plan may be generated to account for coverage of at least a portion of the worksite during one or more previous subterranean monitoring operations. In addition, or in the alternative, the traverse plan may be generated to avoid violation of one or more interior and/or exterior boundaries associated with the worksite and defined in the electronic worksite map.

In another exemplary aspect according to the above-referenced method embodiment, and optionally supplemented by other exemplary aspects referenced herein, the movement of the ground engaging portion of the work implement relative to a surface of the terrain may be controlled based at least in part on output signals from one or more perception sensors associated with the work machine.

In another exemplary aspect according to the above-referenced method embodiment, and optionally supplemented by other exemplary aspects referenced herein, movement of the ground engaging portion of the work implement may be controlled to avoid collisions with one or more perceived objects above the surface of the terrain.

In another exemplary aspect according to the above-referenced method embodiment, and optionally supplemented by other exemplary aspects referenced herein, movement of the ground engaging portion of the work implement may be controlled to substantially maintain a defined distance from the surface of the terrain.

In another exemplary aspect according to the above-referenced method embodiment, and optionally supplemented by other exemplary aspects referenced herein, upon updating the electronic map by automatically mapping one or more parameters associated with the at least first type of detected object to respective locations in the electronic worksite map, the updated electronic worksite map may be uploaded to a remote data storage by a first work machine performing the subterranean monitoring operation, and retrievable by at least a second work machine performing an earth working operation in association with the worksite.

In another exemplary aspect according to the above-referenced method embodiment, and optionally supplemented by other exemplary aspects referenced herein, the one or more parameters may comprise a depth of a corresponding subterranean object as mapped to the updated electronic worksite map, and one or more actuators in association with the earth working operation may be controlled based on a location of the second work machine relative to mapped subterranean objects and associated depths.

In another exemplary aspect according to the above-referenced method embodiment, and optionally supplemented by other exemplary aspects referenced herein, for each of one or more subterranean monitoring operations, data may be stored and optionally aggregated corresponding to detected objects including at least the first type of detected object, one or more parameters associated with the detected objects, and locations associated with the detected objects in a data storage network. An electronic worksite map may be generated or retrieved for an earth working operation associated with a defined worksite, wherein for each of one or more objects detected within the defined worksite, the one or more parameters associated with the at least first type of detected object are automatically mapped to respective locations in the electronic worksite map.

In another embodiment, a system is disclosed herein comprising one or more processors residing upon or otherwise functionally linked to at least a first work machine, and configured to direct the performance of a method according to the above-referenced embodiment and optionally one or more of the described aspects.

Numerous objects, features, and advantages of the embodiments set forth herein will be readily apparent to those skilled in the art upon reading of the following disclosure when taken in conjunction with the accompanying drawings.

DETAILED DESCRIPTION

Figure 1:
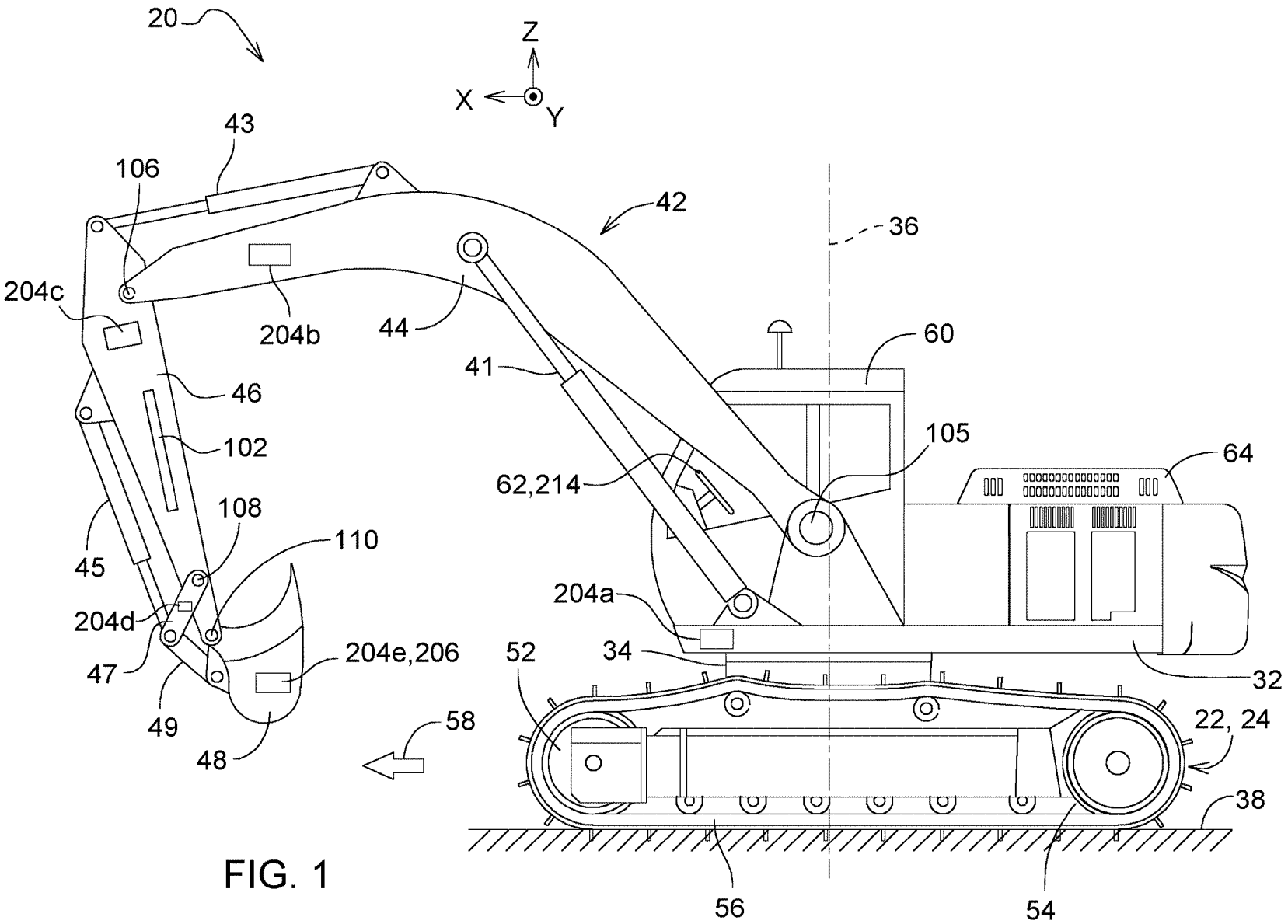
FIG. 1 is a side view representing an excavator as an exemplary work machine according to an embodiment of the present disclosure.

While the making and using of various embodiments consistent with the present disclosure are discussed in detail below, it should be appreciated that the present disclosure provides many applicable inventive concepts that can be embodied in a wide variety of specific contexts. The specific embodiments discussed herein are merely illustrative of specific ways to make and use aspects of the disclosure and do not delimit the scope of the present disclosure.

Referring generally to FIGS. 1-8, various exemplary systems, work machines, and associated methods according to the present disclosure are described in detail. Where the various figures may describe embodiments sharing various common elements and features with other embodiments, similar elements and features are given the same reference numerals and redundant description thereof may be omitted below.

Work machines configured for excavation within a worksite (like an excavator or backhoe loader) typically contain at least one work implement that can be manipulated in three-dimensional (3D) space about the machine chassis. In the industry today, the state of automation involves augmenting the operators control to implement solutions such as grade management systems. These solutions are focused primarily on augmenting operator input to maintain the implement on a desired trajectory for the purpose of precisely managing a surface grade. As the state of automation progresses toward full machine autonomy, capabilities for unlocking further customer value become achievable.

In various embodiments according to the present disclosure, a work machine may further be provided with a system of measurement devices that provide a known position of every rigid body of the work machine in 3D space. This kinematic system measures all rigid body motion and evaluates the pose of the machine chassis relative to earth (pitch/roll/yaw). The system also contains devices for evaluating the geospatial location of the machine, typically through the use of global navigation satellite system (GNSS) positioning with real-time kinematic (RTK) correction. The combined use of these systems allows the work machine to precisely evaluate the location of the implement relative to global coordinates. Understanding the global position of the implement allows the machine to also control the implement to a desired global location. This is the premise of existing solutions for grade management that are offered in the industry today.

In addition to the measurement system described above, a work machine according to the present disclosure may further be provided with a control system capable of manipulating all degrees of freedom for the work implement. This may include, for example, precision control devices within the hydraulic system that are electronically activated (commonly known as "electro-hydraulic actuators"). This allows the machine control system to manage machine trajectories along a control path defined within a design. This system may be advanced enough to deliver a fully autonomous solution capable of running without an operator in control of the machine.

To effectively implement the system being disclosed, the work machine may further include a system for evaluating the elevation of the terrain surrounding the machine. Common technologies that exist in the industry include stereo vision, lidar, radar, and others. These systems provide perception about the machine, allowing for a comprehensive idea of terrain elevations. This information helps to ensure that the machine does not drive the work implement (and associated equipment) into the ground during operation.

In various embodiments as disclosed herein, such a system may further include the capability of surveying for utilities and/or providing ground marking for any identified (or previously surveyed) utility locations. The former capability may involve the use of utility surveying equipment located on the work implement of the machine. In utility surveying applications, several technologies exist for identifying underground utilities, including electromagnetic and ground penetrating radar devices. For an application according to the present disclosure, these devices may be integrated into the machine implement and protected from damage during normal excavating operations. Additionally, or in the alternative, the equipment could potentially be placed in a location along the implement that is generally safe from excavation operations, so long as the technology can deliver accurate feedback at some distance from the ground.

FIG. 1 depicts a representative self-propelled work machine 20 in the form of, for example, a tracked excavator machine, but other suitable work machines for working terrain may fall within the scope of the present disclosure unless otherwise stated. The work machine 20 includes an undercarriage 22 with first and second ground engaging units 24 and further including first and second travel motors (not shown) for driving the first and second ground engaging units 24, respectively. A main frame 32 is supported from the undercarriage 22 by a swing bearing 34 such that the main frame 32 is pivotable about a pivot axis 36 relative to the undercarriage 22. The pivot axis 36 is substantially vertical when a ground surface 38 engaged by the ground engaging units 24 is substantially horizontal. A swing motor (not shown) is configured to pivot the main frame 32 on the swing bearing 34 about the pivot axis 36 relative to the undercarriage 22.

In an embodiment, a swing angle sensor (not shown) may include an upper sensor part mounted on the main frame 32 and a lower sensor part mounted on the undercarriage 22. Such a swing angle sensor may be configured to provide a swing (or pivot) angle signal corresponding to a pivot position of the main frame 32 relative to the undercarriage 22 about the pivot axis 36. The swing angle sensor may for example be a Hall Effect rotational sensor including a Hall element, a rotating shaft, and a magnet, wherein as the angular position of the Hall element changes, the corresponding changes in the magnetic field result in a linear change in output voltage. Other suitable types of rotary position sensors include rotary potentiometers, resolvers, optical encoders, inductive sensors, and the like.

A work implement 42 in the context of the referenced work machine 20 is a boom assembly having numerous components in the form of a boom 44 pivotably connected to the main frame 32 at a linkage joint 105, an arm 46 pivotally connected to the boom 44 at a linkage joint 106, and a working tool 48. The boom 44 is pivotally attached to the main frame 32 to pivot about a generally horizontal axis relative to the main frame 32. The working tool 48 in this embodiment is an excavator shovel, which is pivotally connected to the arm 46 at a linkage joint 110. One end of a dogbone 47 is pivotally connected to the arm 46 at a linkage joint, and another end of the dogbone 47 is pivotally connected to a tool link 49. A tool link 49 in the context of the referenced work machine 20 is a bucket link 49.

The boom assembly 42 extends from the main frame 32 along a working direction of the boom assembly 42. The working direction can also be described as a working direction of the boom 44. As described herein, control of the work implement 42 may relate to control of any one or more of the associated components (e.g., boom 44, arm 46, tool 48).

The first and second ground engaging units 24 as illustrated in FIG. 1 are tracked ground engaging units, but in various embodiments (not shown) may be wheels. Each of the tracked ground engaging units 24 includes a front idler 52, a drive sprocket 54, and a track chain 56 extending around the front idler 52 and the drive sprocket 54. The travel motor of each tracked ground engaging unit 24 drives its respective drive sprocket 54. Each tracked ground engaging unit 24 has a forward traveling direction 58 defined from the drive sprocket 54 toward the front idler 52. The forward traveling direction 58 of the tracked ground engaging units 24 also defines a forward traveling direction 58 of the undercarriage 22 and thus of the work machine 20.

An operator's cab 60 may be located on the main frame 32. The operator's cab 60 and the boom assembly 42 may both be mounted on the main frame 32 so that the operator's cab 60 faces in the working direction 58 of the boom assembly. A control station 62 and display unit 214 may be located in the operator's cab 60.

Also mounted on the main frame 32 is an engine 64 for powering the working machine 20. The engine 64 may be a diesel internal combustion engine. The engine 64 may drive a hydraulic pump to provide hydraulic power to the various operating systems of the work machine 20.

Figure 2:
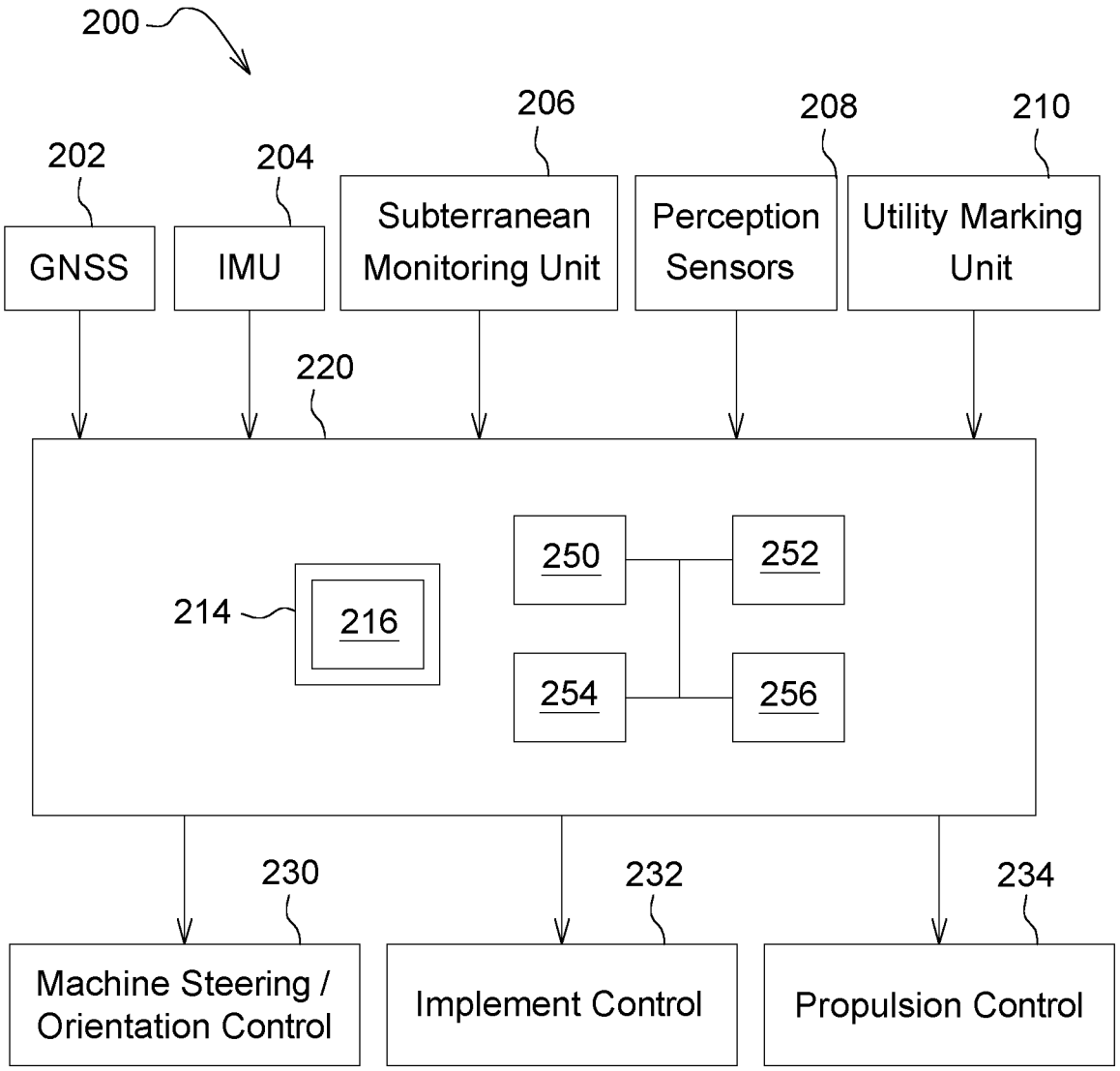
FIG. 2 is a block diagram representing an exemplary control system according to an embodiment of the present disclosure.
Figure 3:
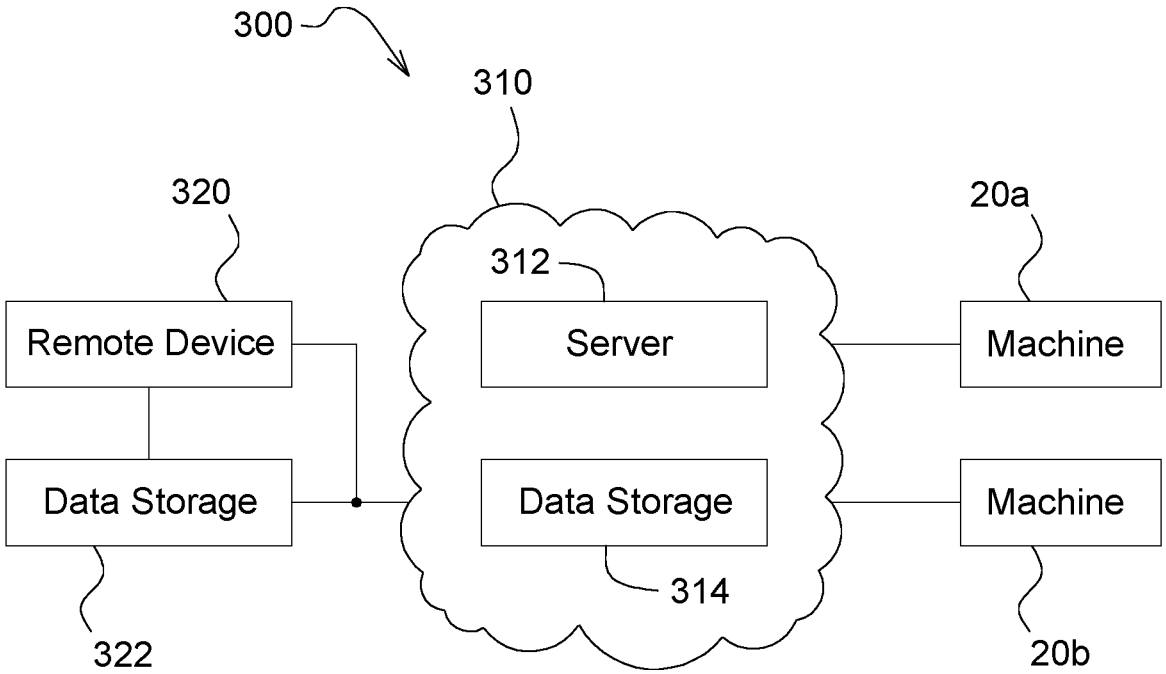
FIG. 3 is a block diagram representing a system for coordinating or otherwise communicating with a plurality of work machines associated with a work area.

As schematically illustrated in FIG. 2, the work machine 20 may include a control system 200 including a controller 220. The controller 220 may be part of the machine control system of the working machine, or it may be a separate control module. The controller 220 is configured to receive input signals from some or all of sensors 202, 204, 206, 208 as further described below. Various of the sensors 202, 204, 206, 208 may typically be discrete in nature, but signals representative of more than one input parameter may be provided from the same sensor, and a sensor system 202, 204, 206, 208 as disclosed herein may further include or otherwise refer to signals provided from the machine control system.

In an embodiment machine location determining sensors 202 may include a global navigation satellite system (GPS) transceiver. Machine location determining sensors 202 may additionally or in the alternative include for example ground speed sensors, steering sensors, or the like, or equivalent inputs from the machine control system.

Work implement position sensors 204 in an embodiment as represented in FIG. 1 may include a set of inertial navigation system (INS) sensors mounted on the work machine 20, as represented generally including multiple sensors 204*a*, 204*b*, 204*c*, 204*d*, 204*e* respectively mounted to the main frame 32, the boom 44, the arm 46, the dogbone 47, and the tool 48. Alternative embodiments of work implement position sensors 204 may include rotary pin encoders mounted at pivot pins to detect the relative rotational positions of the respective components, linear encoders mounted on hydraulic cylinders to detect the respective extensions thereof, and the like.

Respective sensors may for example be mounted on opposing sides of at least one linkage joint. An opposing side of the at least one linkage joint may be ascertained by mounting or affixation of the work implement position sensors 204 on either side of the at least one linkage joint, which is defined as a pivotal linkage joint connecting the one or more components of the work implement 42.

The work implement position sensors 204 may be oriented in an x-, y-, and z-axis coordinate system. Using as one example the sensor 204*c* as mounted on the arm 46 and the sensor 204*d* as mounted on the dogbone 47, respective body frames of the work implement position sensors 204*c* and 204*d* (not shown) may be mounted such that the x-axes of the aforementioned body frames point along the direction of the work implement 42. Alternatively, the body frame of the sensor 204*c* and the body frame of the sensor 204*d* may be mounted in a manner such that the z-axes of the aforementioned body frames point in the direction of the main frame 32 of the work machine 20 (i.e., the excavator). Because an x-, y-, and z-axis coordinate system may be defined arbitrarily, the foregoing are not intended as limiting. The x-, y-, and z-axis coordinate system, though it may be defined arbitrarily, relates to the mechanical axes of rotation for roll (i.e., rotation about the x-axis), pitch (i.e., rotation about the y-axis), and yaw (i.e., rotation about the z-axis).

Some or all of the work implement position sensors 204 in the context of the referenced work machine 20 may include inertial measurement units (each, an IMU). IMUs are tools that capture a variety of motion- and position-based measurements, including, but not limited to, velocity, acceleration, angular velocity, and angular acceleration.

IMUs may include a number of sensors including, but not limited to, accelerometers, which measure (among other things) velocity and acceleration, gyroscopes, which measure (among other things) angular velocity and angular acceleration, and magnetometers, which measure (among other things) strength and direction of a magnetic field. Generally, an accelerometer provides measurements, with respect to (among other things) force due to gravity, while a gyroscope provides measurements, with respect to (among other things) rigid body motion. The magnetometer provides measurements of the strength and the direction of the magnetic field, with respect to (among other things) known internal constants, or with respect to a known, accurately measured magnetic field. The magnetometer provides measurements of a magnetic field to yield information on positional, or angular, orientation of the IMU; similarly to that of the magnetometer, the gyroscope yields information on a positional, or angular, orientation of the IMU. Accordingly, the magnetometer may be used in lieu of the gyroscope, or in combination with the gyroscope, and complementary to the accelerometer, in order to produce local information and coordinates on the position, motion, and orientation of the IMU.

As conventionally known in the art, an accelerometer is an electro-mechanical device or tool used to measure acceleration ($m/s^2$), which is defined as the rate of change of velocity (m/s) of an object. Accelerometers sense either static forces (e.g., gravity) or dynamic forces of acceleration (e.g., vibration and movement). An accelerometer may receive sense elements measuring the force due to gravity. By measuring the quantity of static acceleration due to gravity of the Earth, an accelerometer may provide data as to the angle the object is tilted with respect to the Earth, the angle of which may be established in an x-, y-, and z-axis coordinate frame. However, where the object is accelerating in a particular direction, such that the acceleration is dynamic (as opposed to static), the accelerometer produces data which does not effectively distinguish the dynamic forces of motion from the force due to gravity by the Earth.

Also as conventionally known in the art, a gyroscope is a device used to measure changes in orientation, based upon the object's angular velocity (rad/s) or angular acceleration (rad/s$^2$). A gyroscope may constitute a mechanical gyroscope, a micro-electro-mechanical system (MEMS) gyroscope, a ring laser gyroscope, a fiber-optic gyroscope, and/or other gyroscopes as are known in the art. Principally, a gyroscope is employed to measure changes in angular position of an object in motion, the angular position of which may be established in an x-, y-, and z-axis coordinate frame.

In an embodiment, for each of at least one linkage joint as referenced above, sense elements from the received work implement position sensor output signals may be fused in an independent coordinate frame associated at least in part with the respective linkage joint, the independent coordinate frame of which is independent of a global navigation frame for the work machine 20, wherein for example measurements received by work implement position sensors 204 may be merged to produce a desired output in the work implement 42 of the work machine 20. Accordingly, transformation of the sense elements of received output signals, measured for example by the gyroscopes and the accelerometers in the sensor system 204, may be effectuated using the acceleration measurements and the angular velocity measurements for a joint center of the respective linkage joint, and in an embodiment movement of one or more implement components (e.g., arm, boom, bucket) may be controlled or directed based at least in part on at least one tracked joint characteristic, such as a joint angle, for the respective linkage joint.

As also referenced in FIG. 1, a subterranean monitoring unit 206 may preferably include a GPR unit 206. A GPR unit 206 may for example include energy emitting devices (e.g., a transmitter and antenna) and an energy receiving sensor such as a transducer mounted on a work implement (e.g., bucket) and preferably configured to produce output signals representative of utilities (e.g., pipes, cables, concrete, asphalt, metal, etc.) within the ground. In various embodiments, such signals are produced when at least one surface of the bucket selectively engages the ground surface, but in some embodiments sufficient signal strength may be provided without ground contact. The GPR unit 206 may further include a transmitter, transceiver, and/or the like for communication with, e.g., the controller 220.

One or more perception sensors 208 may also be provided and functionally linked to the controller 220. The perception sensors 208 may include video cameras configured to record an original image stream and transmit corresponding data to the controller 220. In the alternative or in addition, the perception sensors 208 may include one or more of an infrared camera, a stereoscopic camera, a PMD camera, high resolution light detection and ranging (LiDAR) scanners, radar detectors, laser scanners, and the like within the scope of the present disclosure. Corresponding outputs associated with a perception sensor 208 may accordingly relate to images of a perception field (e.g., field of view), point clouds, reflectance/time-of flight data, etc. The number and orientation of perception sensors 208 may vary in accordance with the type of work machine 20 and relevant applications, and a position and size of a perception field encompassed by a respective perception sensor 208 may depend on the arrangement and orientation thereof. For example, the field of view for a video camera may depend on a type of the camera and the camera lens system, in particular the focal length of the lens of the camera. One of skill in the art may further appreciate that, e.g., image data processing functions may be performed discretely at a given perception sensor 208 if properly configured, but also or otherwise may generally include at least some image data processing by the controller 220 or other downstream data processor. For example, perception data from any one or more perception sensors 208 may be provided for three-dimensional point cloud generation, image segmentation, object delineation and classification, and the like, using image data processing tools as are known in the art in combination with the objectives disclosed.

The controller 220 may be configured to produce outputs, as further described below, to a user interface 214 for display to the human operator or other appropriate user. The controller 220 may be configured to receive inputs from the user interface 214, such as user input provided via the user interface 214. Not specifically represented in FIG. 2, the controller 220 of the work machine 20 may in some embodiments further receive inputs from and generate outputs to remote devices associated with a user via a respective user interface, for example a display unit with touchscreen interface. Data transmission between for example a vehicle control system and a remote user interface may take the form of a wireless communications system and associated components as are conventionally known in the art. In certain embodiments, a remote user interface and vehicle control systems for respective work machines 20 may be further coordinated or otherwise interact with a remote server or other computing device for the performance of operations in a system as disclosed herein.

The controller 220 may further, or in the alternative, be configured to generate control signals for controlling the operation of respective actuators, or signals for indirect control via intermediate control units, associated with a machine steering control system 230, a machine implement control system 232, and/or a propulsion (e.g., engine speed) control system 234. The control systems 230, 232, 234 may be independent or otherwise integrated together or as part of a machine control unit in various manners as known in the art. The controller 220 may, for example, generate control signals for controlling the operation of various actuators, such as hydraulic motors or hydraulic piston-cylinder units 41, 43, 45, and electronic control signals from the controller 220 may actually be received by electro-hydraulic control valves associated with the actuators such that the electro-hydraulic control valves will control the flow of hydraulic fluid to and from the respective hydraulic actuators to control the actuation thereof in response to the control signal from the controller 220. In an embodiment, the controller 220 may in the context of a control operation further receive a pivot angle signal from a pivot angle sensor as described above and selectively drive a swing motor automatically to rotate the main frame 32 about the pivot axis 36 relative to the undercarriage 22 to a target pivot position of the main frame 32 relative to the undercarriage 22, as part of an aforementioned control unit 230, 232, 234 or optionally as a separate and/or integrated control unit within the scope of the present disclosure.

The controller 220 may include, or be associated with, a processor 250, a computer readable medium 252, a communication unit 254, data storage 256 such as for example a database network, and the aforementioned user interface 214 or control panel having a display 216. An input/output device, such as a keyboard, touch screen, or other user interface tool may be coupled to the controller 220 via the user interface 214 so that the human operator may input instructions to the controller 220.

It is understood that the controller 220 described herein may be a single controller having all of the described functionality, or it may include multiple controllers wherein the described functionality is distributed among the multiple controllers.

Various "computer-implemented" operations, steps or algorithms as described in connection with the controller 220 or alternative but equivalent computing devices or systems can be embodied directly in hardware, in a computer program product such as a software module executed by the processor 250, or in a combination of the two. The computer program product can reside in RAM memory, flash memory, ROM memory, EPROM memory, EEPROM memory, registers, hard disk, a removable disk, or any other form of computer-readable medium 252 known in the art. An exemplary computer-readable medium 252 can be coupled to the processor 250 such that the processor 250 can read information from, and write information to, the memory/storage medium 252. In the alternative, the medium 252 can be integral to the processor 250. The processor 250 and the medium 252 can reside in an application specific integrated circuit (ASIC). The ASIC can reside in a user terminal. In the alternative, the processor 250 and the medium 252 can reside as discrete components in a user terminal.

The term "processor" 250 as used herein may refer to at least general-purpose or specific-purpose processing devices and/or logic as may be understood by one of skill in the art, including but not limited to a microprocessor, a microcontroller, a state machine, and the like. A processor 250 can also be implemented as a combination of computing devices, e.g., a combination of a digital signal processor (DSP) and a microprocessor, a plurality of microprocessors, one or more microprocessors in conjunction with a DSP core, or any other such configuration.

The communication unit 254 may support or provide communications between the controller 220 and external systems or devices, and/or support or provide communication interface with respect to internal components of the self-propelled work machine 20. The communications unit 254 may include wireless communication system components (e.g., via cellular modem, WiFi, Bluetooth, or the like) and/or may include one or more wired communications terminals such as universal serial bus ports.

The data storage 256 as further described below may, unless otherwise stated, generally encompass hardware such as volatile or non-volatile storage devices, drives, memory, or other storage media, as well as one or more databases residing thereon.

As noted above, various operations as disclosed herein, for example relating to subterranean monitoring operations, utility marking operations, earth working operations, and the like, may be executed via a controller 220 for a given work machine 20, wherein the controller may be a discrete device or integrated with a vehicle control system or equivalent. As further represented in FIG. 3, in various embodiments as disclosed herein operations may further or in the alternative be executed via a distributed system 300 including one or more remote processors, such as servers 312 in a cloud platform 310 or other computing devices 320 such as for example hosted servers or mobile user devices, independently or in association with a local controller 220 for each of one or more work machines 20*a*, 20*b*. Each remote processor 312, 320 may be respectively or collectively associated with cloud data storage 314 or distributed data storage 322 having for example electronic worksite maps, worksite planning information, work machine information, and the like retrievably stored thereon and collectively accessible for execution of the operations as disclosed herein.

Figure 4:
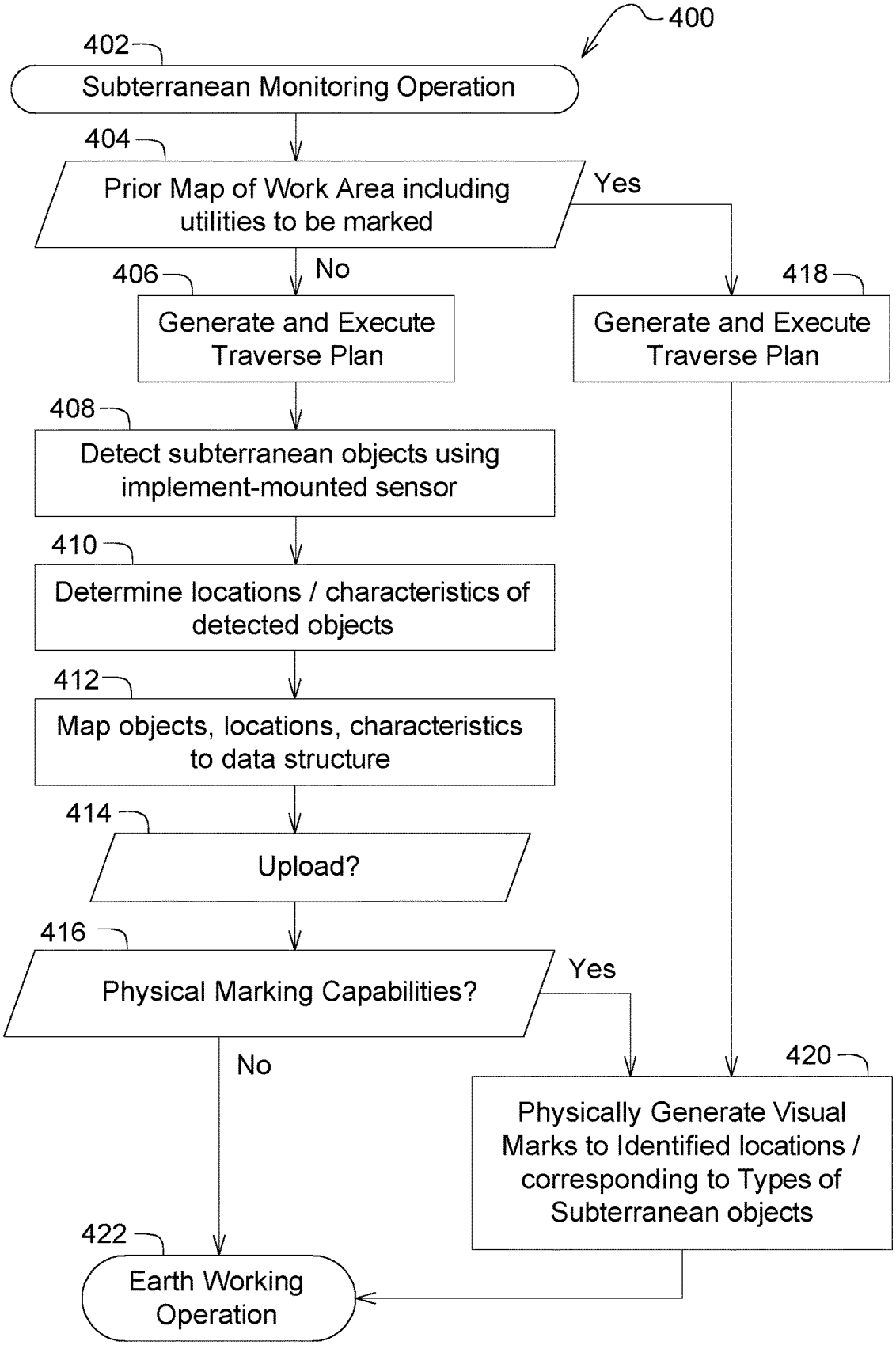
FIG. 4 is a flowchart representing an exemplary embodiment of a method as disclosed herein.

In FIG. 4, the depicted flowchart represents an exemplary embodiment of a method 400 for operating one or more work machines, for example in association with utility surveying and marking of a work site. While the illustrated embodiment may include a specific arrangement of steps, inputs, outputs, and the like, it may be understood that certain steps may be combined, performed in a different order, or even omitted altogether in other embodiments within the scope of the present disclosure, unless otherwise specifically noted herein.

In embodiments as described below the work machines are excavators, with at least a first excavator having a subterranean monitoring unit (e.g., including GPR, EML, and/or equivalent sensing technologies) mounted on or integrated into its earth working implement (bucket), and/or a ground marking unit, but alternative work machines, implements, and configurations, are within the scope of alternative embodiments. One of skill in the art may appreciate that a method as disclosed herein may be performed in various stages, and by different work machines and even types of work machines, unless otherwise expressly noted. For example, a subterranean monitoring operation may be performed by a work machine having ground marking capabilities and/or earth working capabilities, or may be performed by a first work machine having neither, wherein a second work machine having ground marking capabilities and/or earth working capabilities may subsequently perform such activities, at least in part based on detected object data provided during the subterranean monitoring operation of the first work machine (and potentially other work machines as well).

In addition, steps and functions described herein for mapping data to a worksite map, storing and retrieving detected object data, etc., may be performed by a controller associated with a work machine, collectively performed by multiple controllers associated with respective work machines, performed by one or more remote processors such as arranged in a cloud computing environment, collectively performed by one or more work machine controllers and one or more remote processors, etc.

At least a first work machine according to the method 400 may be configured to perform at least a subterranean monitoring operation (step 402), which may include one or more of a utility surveying operation and a utility marking operation as further described below, and independent of an earth working operation of the bucket. In some embodiments, for example, subterranean monitoring operations may be performed by a first excavator, which updates a worksite map for the benefit of one or more additional work machines and earth working operations performed in the worksite by the work machines.

The method 400 may optionally begin, for example in association with a subterranean monitoring operation with respect to a first work machine, and if such a map is available, with retrieval of an existing electronic worksite map including utilities to be identified and marked (step 404). Retrieval of the existing worksite map may be performed upon initiation of the subterranean monitoring operation, as a trigger for initiating the subterranean monitoring operation, or in some cases not at all wherein for example an electronic worksite map is to be generated as part of the subterranean monitoring operation.

If such a map does not exist, or is not presently available (i.e., "no" in response to the illustrated query in step 404), the method 400 continues with the generation and execution of a plan for traversing the work area (step 406) and a utility surveying operation which includes detecting the presence of subterranean objects through the use of a sensor mounted on a work implement (step 408), for example a ground-penetrating radar sensor or electromagnetic location device mounted on a work implement which is kept close to or in contact with the surface of the ground during traverse of the work area.

In some embodiments, a map (or equivalent data structure) may not exist which correlates previously identified subterranean objects with specified locations within a work area, but nonetheless provides known information regarding, e.g., exterior and/or interior boundaries of the work area, terrain features of the work area, etc. Alternatively, a map may also not exist to provide such information regarding the work area, wherein for example an initial traverse plan may be generated, and during execution thereof a new (and subsequently "current") traverse plan is generated to replace the initial traverse plan based on newly identified and applied boundaries, terrain features, etc. For example, obstructions which are perceived during execution of the traverse plan may be identified as preferably being avoided, wherein the traverse plan may be modified in view of this obstruction and further to account for optimal coverage of the work area notwithstanding.

Figure 5:
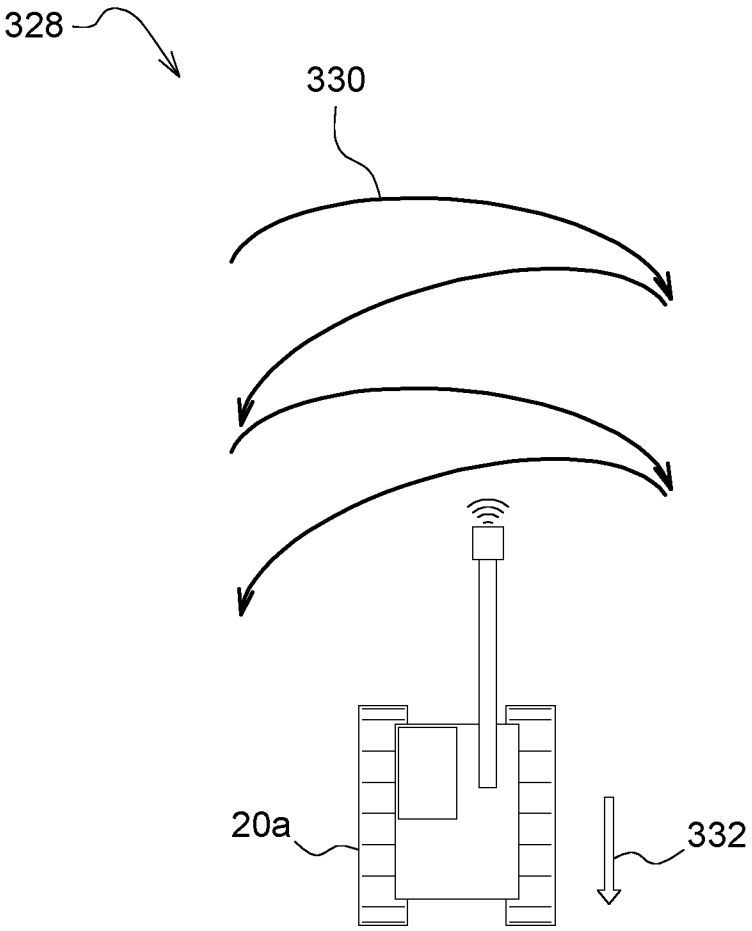
FIG. 5 is an overhead view representing an exemplary sweeping motion of a work machine while traversing a worksite according to an embodiment of the method of FIG. 4.

For example, as illustrated in FIG. 5, a generated automation routine may be executed to manage, and preferably to automatically control, "sweeping" motion 330 of the surveying equipment while the work machine 20 traverses a path 332 in a specified trajectory across the work area 328. The implement sweeping motion 330 may be achieved via the swing motion of the machine, while forward motion of the machine may be achieved by the vehicle transmission (or tracking) system. The system may further preferably utilize the machine perception system to ensure that a ground engaging portion of the work implement (and accordingly the utility surveying equipment mounted, integrated, or otherwise associated therewith) is not driven into the terrain during motion.

Figure 6:
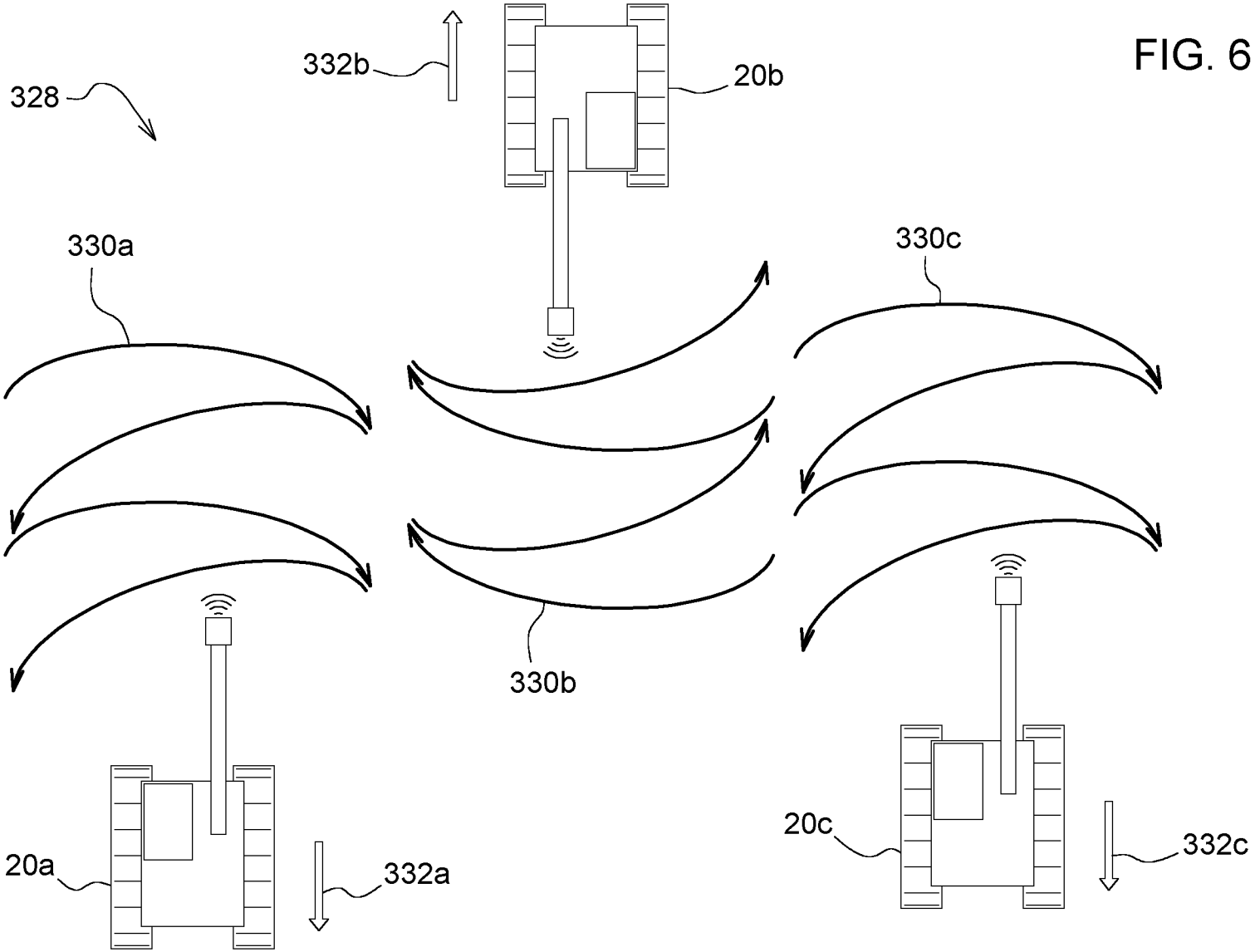
FIG. 6 is an overhead view representing multiple exemplary passes of one or more work machines while traversing a worksite according to an embodiment of the method of FIG. 4.

For the purpose of planning the machine path 332, the system may be constrained by the known exterior and/or interior boundaries of the work area 328, potentially through the use of a site design file. This would allow the work machine 20 to plan a path of motion that is within the boundaries of the work area 328, and would allow the work machine 20 to know when it needs to change direction or turn around. This sweeping motion 330 may be maintained across several passes across the work area 328 in order to fully survey the entire space, as illustrated in FIG. 6.

A traverse plan may in various embodiments be generated for optimal coverage of the work area, not only to avoid or otherwise stay within known boundaries for the work area, but further to avoid duplicative coverage of the terrain from sweeping motions in parallel or subsequent traverses of the work area. The traverse plan may further be generated to avoid collisions or other types of encounters with respect to previously identified objects within the work area, or objects perceived using the perception sensors during an existing surveying operation, wherein for example an initial traverse plan may be dynamically altered to produce a current traverse plan based on the perceived surroundings and a determined impact of engagement therewith.

The method 400 continues with determining of respective locations and relevant characteristics of the subterranean objects identified using the subterranean monitoring sensors and in accordance with the executed traverse plan (step 410). Any identification of an underground utility, optionally along with characteristics and other relevant indicia associated for example with the type of object, may be further correlated to a geospatial location for the work implement at the moment of capture (step 412). These points could then be built into a data structure logging or otherwise representing the utility positions about the entire jobsite. In various embodiments, the data structure may preferably be uploaded (step 414) and subsequently accessible by each of various work machines, operators, users, or the like assigned to or otherwise associated with the respective work area.

For example, upon completing a scan of an area (or a portion thereof), the work machine performing the utility surveying operation may generate an electronic worksite map, or in the context where an existing worksite map was initially retrieved may update the electronic worksite map based at least in part on the current subterranean monitoring operation. For example, multidimensional parameters may be generated for the electronic worksite map, with two coordinates (x, y) being associated with a current location of the work machine (e.g., a location of the bucket) as determined based on input signals from one or more position sensors, and in some embodiments with information for a third coordinate (z) as corresponding to the x, y location being based at least in part on input signals from the subterranean monitoring unit.

In an embodiment, one or more position characteristics of the bucket including the subterranean monitoring unit may be obtained in part by fusing input signals from the position sensor (e.g., IMU) associated with the bucket with position signals from the position sensor (e.g., IMU) associated with the main frame in a coordinate system independent of a global navigation frame for the map, further wherein the multidimensional parameters are generated at least in part by converting the one or more position characteristics of the bucket into coordinates associated with the global navigation frame.

Embodiments of a system and method as disclosed herein may accordingly pair a bucket including position sensors and a subterranean monitoring unit as disclosed herein with tool tip projections and position sensors on the work machine to preserve and upload a stored log of scanned locations and subterranean objects, conditions, and the like. The same location, for example identified as latitude and longitude (x, y coordinates) in a global coordinate frame can then be referenced by the work machine having performed the subterranean monitoring operation, or another work machine as discussed below for performing later earth working operations (step 422), and further correlated with the subterranean objects, conditions, and the like. In some embodiments, a detected depth coordinate (z) may be associated with the subterranean objects, conditions, and the like. This may for example enable work machines that are not themselves equipped with subterranean monitoring units to nonetheless utilize the information obtained by the first work machine (having performed the subterranean monitoring operation), further enabling the respective work machine operators to observe detected subterranean conditions without leaving the cab, or having other workers on standby to apply paint markers, etc.

In an embodiment, when a subterranean object (e.g., detected utility) has been identified, the method 400 may continue, if the work machine has physical marking capabilities (i.e., "yes" in response to the query in step 416), with the physical generation of visual markings to identified locations on the ground surface which correspond to the identified subterranean objects (step 420). The markings may in some embodiments be applied to only certain identified types of subterranean objects, such as for example those types which are determined to require removal, avoidance, or the like. In other embodiments, different types of markings (e.g., different colors or other indicia) may be selectively applied to the ground surface based on respective types of subterranean objects, such as based on a criticality of removal or avoidance thereof.

Returning to step 404, if a preexisting map of the work area including utilities to be marked was available (i.e., "yes" in response to the query), and the work machine in question was equipped with a utility marking unit, the method 400 may alternatively proceed to step 418 and generation and execution of a traverse plan for the purpose of utility marking in step 420, without the need for utility surveying. It may be understood, however, that the different method paths are not exclusive, and in various embodiments a work machine may proceed with a utility surveying operation even where an existing map was available and retrieved for utility marking in the relevant portions of the worksite, while simultaneously surveying the worksite for additional utilities requiring mapping and marking.

In various embodiments as disclosed herein, utility ground marking units and associated systems may include containers of high visibility material that can be directly and selectively dispensed to the ground surface. A marking material within the scope of the present disclosure may for example include paint, dye, chalk, or the like, without limitation as to compositions and/or combinations thereof. A ground marking unit in various embodiments may include a dispensing mechanism such as for example sprayers, wands, pumps, tubing, and the like, and which is coupled to or otherwise contains its own high visibility material reservoir, or one that for example accommodates industry standard paint cans. The ground marking unit could be further expanded to include different colors for identifying different utilities. The ground marking unit may typically be automatically actuated, but in various embodiments may include a manual actuator for selective application of the marking material in addition or alternatively with respect to the automatic actuation. The ground marking unit may be mounted, integrated, or otherwise disposed with respect to the work implement in a manner which provides desired protection from damage during utilization, similar to the surveying equipment described previously.

Figure 7:
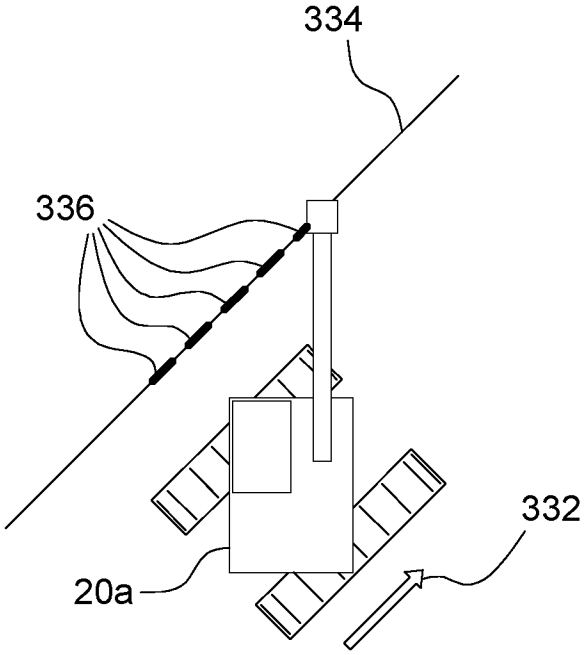
FIG. 7 is an overhead view representing an exemplary utility path planning and marking sequence performed by a work machine while traversing a worksite according to an embodiment of the method of FIG. 4.

Once equipped, and as further illustrated in FIG. 7, a traverse plan and automation routine as developed in step 418 for planning the path of motion across the work area 328 may be executed to move the machine and place the implement in the location of the identified underground utilities, for example along an identified path 334 such that markings 336 may be applied thereto. These utilities could be provided to the machine as part of a pre-designed surface file, where a surveyor has already identified the utility locations. The system may further utilize the onboard perception system to identify the elevation of the ground surface at the point of interest so that the utility marking unit can be held at an appropriate height to properly place an identifying mark, for example maintaining a predetermined distance from the ground surface based on a determined profile thereof.

Figure 8:
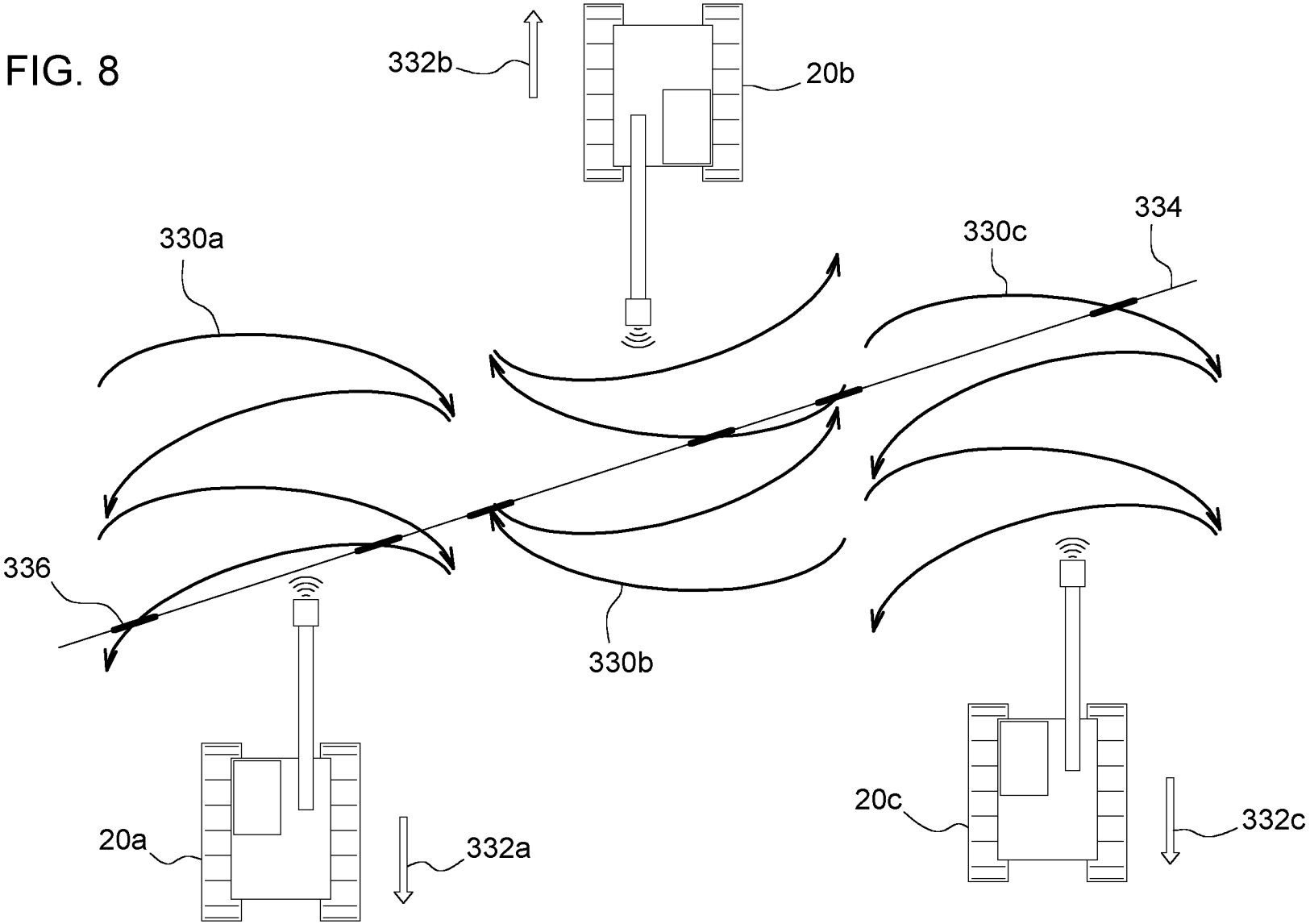
FIG. 8 is an overhead view representing multiple exemplary passes of one or more work machines performing identification and marking of underground utilities while traversing a worksite according to an embodiment of the method of FIG. 4.

As further illustrated in FIG. 8, both the surveying operation and the marking operation may in some embodiments be utilized together, where applicable, to allow for both identifying and marking of underground utilities about a work area 328. While a work machine 20 or a plurality of work machines 20*a*, 20*b*, 20*c* traverses the site in respective "sweeping" motions 330*a*, 330*b*, 330*c* to identify utility locations (e.g., along path 336), the one or more work machines could utilize respective utility marking units to mark the ground with markings 336 as the utilities are identified or otherwise encountered.

Upon completion of a subterranean monitoring operation, the method 400 may for example proceed with an earth working operation (step 422) or a subsequent subterranean monitoring operation for an alternative work area (i.e., return to step 402). The earth working operation may be performed by the same work machine 20 having performed the subterranean monitoring operation, using the generated or updated electronic worksite map which may for example be stored locally on the work machine 20 or remotely but accessible by the controller 220.

In an embodiment, the generated or updated electronic worksite map may be displayed during the earth working operation on a display unit accessible to an operator of the work machine 20. The map may for example include a typical overhead view of the worksite along with notes, indicia, or the like with respect to a detected subterranean object or condition at specified coordinates.

In another example, in addition or in the alternative to the display function, the method 400 may include automatic control of one or more actuators in association with the earth working operation and based on at least one determined subterranean condition, such as for example to maintain a minimum distance between the bucket and any (or specific examples of) subterranean objects.

In another example, in addition or in the alternative to the display function and/or the automatic control, the method 400 may include alert functions based on at least one determined subterranean condition, such as for example to provide audible or visual notifications when a detected or predicted distance between the bucket and any (or specific examples of) subterranean objects is at or below a defined threshold.

As noted above, the earth working operation (step 422) may be performed by the same work machine 20 having performed the subterranean monitoring operation and generated or updated the electronic worksite map. An earth working operation may further or alternatively be performed by a different work machine 20*b* using a shared version of the generated or updated electronic worksite map, for example where the map has been uploaded to a remote data storage (e.g., cloud-based) by the work machine 20*a* having performed the subterranean monitoring operation, and is retrievable from the remote data storage by the work machine 20*b*. This may be advantageous for work machines 20*b* lacking subterranean monitoring features of their own, and particularly where three-dimensional subterranean feature coordinates can be referenced for display and/or control purposes.

In some embodiments, subterranean monitoring operations may be performed, not only without a preexisting worksite map by which the subterranean monitoring operation is controlled and to which detected object data is directly mapped, but further wherein detected object data from a plurality of subterranean monitoring operations may be stored, and optionally aggregated for later use. For example, an earth working operation may later be contemplated in association with a defined worksite. If an electronic worksite map already exists for such a worksite, it may be retrieved from data storage, or alternative a new electronic worksite map be generated for the purpose of the contemplated earth working operation. For each of one or more objects detected within the defined worksite, the one or more parameters associated with the detected objects, or at least a selected type of detected object, may then be automatically mapped to respective locations in the electronic worksite map.

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item Band item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A method of operating a work machine comprising a machine frame, a one or more ground engaging units supporting the machine frame and configured to traverse a terrain, an attachment external to the machine frame, and a subterranean monitoring sensor associated with the attachment and arranged to travel with the work machine during traverse of the terrain, the method comprising:

detecting at least a first type of subterranean object, via output signals from the subterranean monitoring sensor;

automatically mapping one or more parameters associated with the at least first type of detected object to respective locations in an electronic worksite map;

determining one or more position characteristics of the subterranean monitoring sensor by fusing input signals from at least a first position sensor associated with the attachment with position signals from a second position sensor associated with the machine frame in a coordinate system independent of a global navigation frame for the electronic worksite map; and determining a location of the subterranean monitoring sensor at least in part by converting the determined one or more position characteristics of the subterranean monitoring sensor into coordinates associated with the global navigation frame.

2. The method of claim 1, further comprising:

accessing the electronic worksite map residing in data storage, and generating a traverse plan according to the worksite map and associated with a subterranean monitoring operation;

during the subterranean monitoring operation, controlling at least a trajectory at which the work machine traverses the terrain, according to the generated traverse plan.

3. The method of claim 2, further comprising:

via a ground marking unit associated with the work machine, automatically generating a visual mark on the surface of the terrain corresponding to identified locations of the at least first type of subterranean object, wherein the identified locations are previously stored and retrieved from the electronic worksite map and/or correspondingly detected via the subterranean monitoring sensor.

4. The method of claim 2, wherein the traverse plan is generated to account for coverage of at least a portion of the worksite during one or more previous subterranean monitoring operations.

5. The method of claim 2, wherein the traverse plan is generated to avoid violation of one or more interior and/or exterior boundaries associated with the worksite and defined in the electronic worksite map.

6. The method of claim 2, wherein the work machine comprises a work implement moveable relative to the machine frame and having a ground engaging portion for working the terrain, the traverse plan associated with the subterranean monitoring operation is independent of an earth working operation of the work implement, and the subterranean monitoring sensor is positioned in association with the ground engaging portion of the implement, the method further comprising:

determining one or more position characteristics of the subterranean monitoring sensor by fusing input signals from at least a first position sensor associated with the work implement with position signals from a second position sensor associated with the main frame in a coordinate system independent of a global navigation frame for the electronic worksite map; and determining a location of the subterranean monitoring sensor at least in part by converting the determined one or more position characteristics of the subterranean monitoring sensor into coordinates associated with the global navigation frame.

7. The method of claim 6, further comprising:

via a ground marking unit associated with the ground engaging portion of the work implement, automatically generating a visual mark on the surface of the terrain corresponding to identified locations of the at least first type of subterranean object, wherein the identified locations are previously stored and retrieved from the electronic worksite map and/or correspondingly detected via the subterranean monitoring sensor.

8. The method of claim 6, wherein the traverse plan is generated to account for coverage of at least a portion of the worksite during one or more previous subterranean monitoring operations.

9. The method of claim 6, wherein the traverse plan is generated to avoid violation of one or more interior and/or exterior boundaries associated with the worksite and defined in the electronic worksite map.

10. The method of claim 6, wherein the movement of the ground engaging portion of the work implement relative to a surface of the terrain is controlled based at least in part on output signals from one or more perception sensors associated with the work machine.

11. The method of claim 10, wherein movement of the ground engaging portion of the work implement is controlled to avoid collisions with one or more perceived objects above the surface of the terrain.

12. The method of claim 10, wherein movement of the ground engaging portion of the work implement is controlled to substantially maintain a defined distance from the surface of the terrain.

13. The method of claim 2, wherein upon updating the electronic map by automatically mapping one or more parameters associated with the at least first type of detected object to respective locations in the electronic worksite map, the updated electronic worksite map is uploaded to a remote data storage by a first work machine performing the subterranean monitoring operation, and retrievable by at least a second work machine performing an earth working operation in association with the worksite.

14. The method of claim 13, wherein the one or more parameters comprise a depth of a corresponding subterranean object as mapped to the updated electronic worksite map, the method further comprising automatically controlling one or more actuators in association with the earth working operation based on a location of the second work machine relative to mapped subterranean objects and associated depths.

15. The method of claim 1, further comprising:

storing, for each of one or more subterranean monitoring operations, data corresponding to detected objects including at least the first type of detected object, one or more parameters associated with the detected objects, and locations associated with the detected objects in a data storage network;

generating or retrieving an electronic worksite map for an earth working operation associated with a defined worksite;

for each of one or more objects detected within the defined worksite, automatically mapping the one or more parameters associated with the at least first type of detected object to respective locations in the electronic worksite map.

16. A system for operating a work machine comprising a machine frame and one or more ground engaging units supporting the machine frame and configured to traverse a terrain, the work machine further comprising a work implement moveable relative to the machine frame via one or more actuators and traversable across the terrain independently of movement of the work machine, the system comprising:

one or more processors residing upon or otherwise functionally linked to the work machine, and configured to:

detect at least a first type of subterranean object, via output signals from a subterranean monitoring sensor associated with the work machine; and automatically map one or more parameters associated with the at least first type of detected object to respective locations in an electronic worksite map.

17. The system of claim 16, wherein the one or more processors are further configured to:

access the electronic worksite map, and generate a traverse plan according to the worksite map and associated with a subterranean monitoring operation;

during the subterranean monitoring operation, control at least a trajectory at which the at least first work machine traverses the terrain according to the generated traverse plan.

18. The system of claim 17, wherein the one or more processors are further configured to:

via a ground marking unit associated with the work machine, automatically generate a visual mark on the surface of the terrain corresponding to identified locations of the at least first type of subterranean object, wherein the identified locations are previously stored and retrieved from the electronic worksite map and/or correspondingly detected via the subterranean monitoring sensor.

19. The system of claim 16, wherein the work implement comprises a ground engaging portion for working the terrain, the traverse plan associated with the subterranean monitoring operation is independent of an earth working operation of the work implement, and the subterranean monitoring sensor is positioned in association with the ground engaging portion of the implement, the one or more processors further configured to:

determine one or more position characteristics of the subterranean monitoring sensor by fusing input signals from at least a first position sensor associated with the work implement with position signals from a second position sensor associated with the machine frame in a coordinate system independent of a global navigation frame for the electronic worksite map; and determine a location of the subterranean monitoring sensor at least in part by converting the determined one or more position characteristics of the subterranean monitoring sensor into coordinates associated with the global navigation frame.

* * * * *